US005151312A

United States Patent [19]

Boeri

[11] Patent Number: 5,151,312

[45] Date of Patent: Sep. 29, 1992

[54] HOLLOW, NON-NESTABLE PACKING PEANUTS OF RECYCLED NEWSPAPER

[76] Inventor: John L. Boeri, RR 1, Box 798, Woodstock, Vt. 05091

[21] Appl. No.: 599,545

[22] Filed: Oct. 18, 1990

[51] Int. Cl.[5] ..... B65D 81/12; B32B 3/00

[52] U.S. Cl. ..... 428/156; 428/131; 428/163; 428/166; 428/174; 428/178; 428/181; 428/188; 428/116; 428/537.5; 428/903.3; 206/584; 206/521; 206/814

[58] Field of Search ..... 428/131, 156, 163, 166, 428/174, 178, 181, 188, 116, 537.5, 903.3; 206/584, 521, 814; 261/DIG. 72

[56] References Cited

U.S. PATENT DOCUMENTS

| | | | |
|---|---|---|---|
| 1,725,429 | 9/1927 | Schaaek, Jr. | 261/DIG. 72 |
| 2,649,958 | 8/1953 | Rausch | 206/46 |
| 2,834,466 | 5/1958 | Hament | 261/DIG. 72 |
| 3,074,543 | 1/1963 | Stanley | 206/46 |
| 3,233,659 | 7/1962 | Nettel et al. | 261/DIG. 72 |
| 3,384,221 | 5/1968 | Houtman | 206/46 |
| 3,430,934 | 5/1969 | Weishaupt | 261/DIG. 72 |
| 3,481,455 | 12/1969 | Graham et al. | 206/584 X |
| 3,650,877 | 3/1972 | Johnson | 161/47 |
| 3,896,934 | 7/1975 | Graham et al. | 206/523 |
| 4,166,875 | 9/1979 | Bussey, Jr. | 428/159 |
| 4,169,179 | 9/1979 | Bussey, Jr. | 428/159 |
| 4,215,166 | 7/1980 | Bussez, Jr. | 206/584 X |
| 4,514,453 | 4/1985 | Bussey, Jr. | 428/159 |
| 4,599,269 | 7/1986 | Kohaut et al. | 206/584 X |
| 4,606,965 | 8/1986 | Bussey | 428/156 |
| 4,619,862 | 10/1986 | Solaolowski et al. | 428/326 |
| 4,621,022 | 11/1986 | Kohaut et al. | 206/584 X |
| 4,680,219 | 7/1987 | Vernois et al. | 428/222 |
| 4,997,091 | 3/1991 | McCreu | 206/584 |

OTHER PUBLICATIONS

Article entitled "Environmentalism's Cost: Peanuts", Valley News newspaper, White River Junction, Vermont, Apr. 13, 1989.

*Primary Examiner*—Ellis P. Robinson
*Assistant Examiner*—William P. Walkins, III
*Attorney, Agent, or Firm*—Sughrue, Mion, Zinn, Macpeak & Seas

[57] ABSTRACT

Lightweight, non-nestable packing peanuts formed of recycled newspaper of molded hollow thin wall shell form preferably of cup shaped configuration have flanges, apertures, and double wall dividers integrally molded therein. A radial flute over the vertical height of the exterior wall of the shell provides shape stability to a portion of the shell to resist physical crushing of the shell and facilitates the structural cushioning of packed fragile objects in cartons or the like for shipping purposes. The shell is rendered resilient over other portions for absorbing the energy resulting from impact forces transmitted through the fold filled towards a packed fragile object. A divider having spaced parallel walls may extend from an end of the shell at the base and include an integral transverse wall to separate the shell into two halves which may be flexed towards and away from each other, at the gap between the divider walls.

21 Claims, 3 Drawing Sheets

HOLLOW, NON-NESTABLE PACKING PEANUTS OF RECYCLED NEWSPAPER

FIELD OF THE INVENTION

This invention relates to lightweight, resilient packing peanuts as packaging fill material and, more particularly, to such peanuts which are formed of a lightweight biodegradable recycled waste material of hollow form, energy absorbing capability and shape stability to provide sufficient structural cushioning and elasticity to prevent damage to a product surrounded by the peanuts and under compression packing during product shipment in a sealed package or carton.

BACKGROUND OF THE INVENTION

Loose fill packing elements have evolved over the years for insulating articles transported in shipping containers such as cardboard cartons against vibration and impact.

Fragile articles have been packaged in cardboard containers such as boxes and cartons using loose fill packaging material of various forms. Such fill as shredded paper, excelsior or straw padding has in the past provided a shock absorbing cushion. Fill elements having the property of resilience and light weight include popped corn which is the subject of U.S. Pat. No. 2,649,958. U.S. Pat. No. 3,074,543 describes fill material constituting tiny collapsible cylinders such as waste or cut straw stock.

Expanded plastic foam has been found to be particularly suited for use as fill material since the foam has good shock absorbing characteristics, is lightweight, resists crushing and has a high volume of cells or void spaces ranging from 25% to 85% of the total volume of the loose fill elements.

U.S. Pat. No. 3,896,934 discloses foam plastic packing elements, originally of cylindrical or annular shape which are expanded and curled to form a hollow configuration of a form which when viewed in side elevation, resembles a fleur de lis and when viewed from an end, takes the configuration of a greek letter $\theta$ or the number 9.

U.S. Pat. No. 4,166,875 discloses loose fill packing elements which are free flowing, formed of styrofoam, non-nesting and non-interlocking and of block form having a base or body portion and three leg portions extending substantially from the body portion and defining recesses between the leg portions, with the leg portions having a width in excess of the width of the recess. The block may take the form of the letter W.

Companion U.S. Pat. No. 4,169,179 discloses such loose fill packaging elements of U-shaped configuration, whose bottom of the base portion has longitudinally extending slits at laterally spaced position to provide a spring-like construction to the two legged portions thereof.

U.S. Pat. No. 4,514,453 discloses loose fill packing elements formed of resilient foam thermoplastic material such as polystyrene or polyethylene which elements are of generally S-shaped configuration such that the elements abut each other without interlocking.

U.S. Pat. No. 3,650,877 teaches the formation of a resilient cushioning dunnage element of helical coil-like configuration by crumpling a web of paper into a relatively narrow strip and pressure forming the strip into helical form.

In today's world, where man is continuing to pollute the environment, the polystyrene fill elements not only represents significant volume, but upon the package arrival, such elements must be disposed of. While they are reusable conventionally they are thrown away. Waste management represents a significant problem to this country, and to the world. Existing landfills capable of receiving the styrofoam packaging element are being rapidly filled with our day-to-day garbage and other waste. Importantly, the styrofoam fill elements do not break down when thrown away and due to their high volume, and they take up considerable space which cannot be reused.

The Applicant, in early 1989, conceived of packaging elements formed of recycled newspaper, mass produced by a vacuum molding process from a liquid slurry of water and chopped newspaper, identical to the material making up egg cartons as a replacement for plastic foam elements wholly of cellulose, in the form of hand-pressed cup-shaped pellets.

It is, therefore, a primary object of this invention to provide improved loose fill packaging elements of cellulose fibers, of recycled, shredded newspaper, trimmings from newsprint and envelopes, which may be readily manufactured by molding a slurry formed solely of cellulose and water, in a vacuum mold into thin hollow walled shells which include molded in structural elements to provide localized rigidity, which may be of hemispheric, oblong, truncated cone or polygonal shape, which are non-nesting, lightweight, energy absorbing and which inherently provide structural cushioning or elasticity to duplicate the sponginess of the prior solid styrofoam peanuts.

DESCRIPTION OF THE PREFERRED EMBODIMENTS

The present invention is based on harmonizing worldwide efforts to promote research management in the replacement of styrofoam peanuts with those made from a recycled newsprint or the like of lightweight hollow form constructed so that the peanut is highly energy absorbing, dust-free and flowable, i.e., dispensable from a hopper. Recycled newspaper, trimmings from newsprint and envelopes, provide an excellent source for cellulose fiber and chopped newspapers readily permit molding in a vacuum molding process. A slurry of chopped newspapers and water is formed on a ratio of 16 parts water to 1 part chopped newspaper or like cellulose fiber source. The peanuts in the form of a thin walled hollow shell incorporate integral structural elements or parts for maintaining, in general, the rigidity of the molded hollow product. The molding technique itself is an outgrowth of the formation of paper (cellulose), egg cartons and trays using wet pulp (newspaper/water slurry). The invention, in part, is directed to thin wall, hollow shell peanuts of hemispheric shape, or in the form of oblong and truncated hollow cones and polygons.

Figure 13:
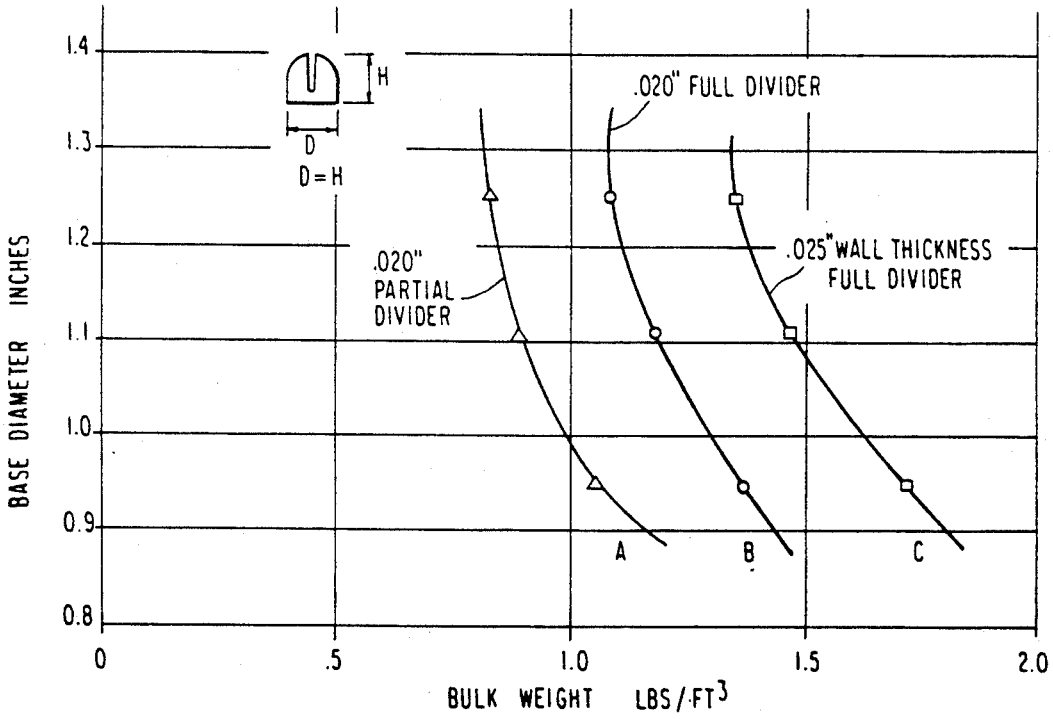
FIG. 13 is a plot of bulk density versus packing peanut shape employing a plurality of hollow, non-nestable packing peanuts of recycled newspaper of the form illustrated in FIG. 2 and variations thereof to facilitate optimization of the packing peanuts of this invention of recycled newspaper as an effective substitute for styrofoam solid body peanuts employed in the past.

By fabricating a plurality of wooden samples of desired form thin walled hollow shells, and packing them in different size boxes of known volume, the applicant generated a number of graphs similar to that of FIG. 13 to determine the average number of pieces required to make a cubic foot of fill material. The graphs, therefore, are a measure of packing efficiency with a lower efficiency indicating a more desirable shape, Further, the shapes were particularly configured so as to be non-symmetrical or keyed, thereby rendering them non-nestable.

Factors in addition to shape design incorporated in the peanuts in accordance with this invention are weight, energy absorption and shape stability. Properties of the peanut necessary to their desired action to provide structural cushioning lie principally in hinging components, incorporation of flanges, variance in wall thickness.

The creation of dimpled webs of molded recycled newspaper material provide the necessary elasticity of the thin walled hollow shell from wet paper pulp, in particular portions thereof, such that the peanuts of this invention had inherent energy absorbing capability duplicating the "sponginess" of the solid styrofoam peanuts which they were intended to replace. It should be appreciated that the individual packing peanuts capable of making a bulk fill of a carton or container is only one form in which the invention is usable, by manufacturing the components within a base sheet as uniform dimples therein. The molded recycled newspaper sheet itself acts capably as a protective wrapping, similar to bubble packed sheets protecting an article wrapped by such sheets, or the dimple projections can be severed from the base sheet as packing peanuts.

Figure 1:
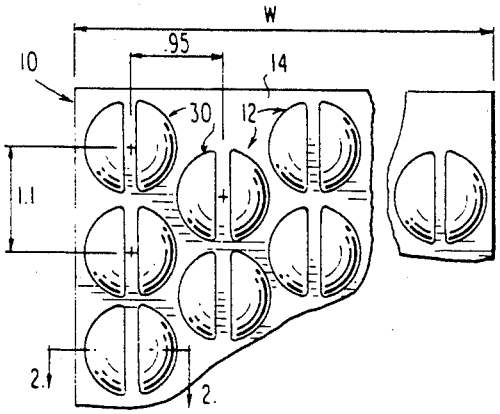
FIG. 1 is a bottom plan view of a packing sheet of surface embossed cellulose fiber content biodegradable, lightweight, energy absorbing dust-free packaging fill material forming one aspect of the present invention.
Figure 2:
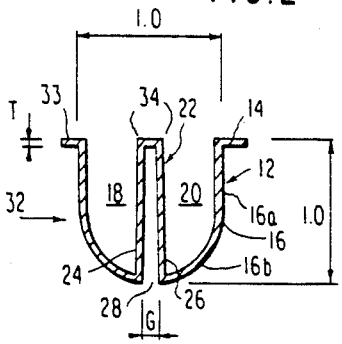
FIG. 2 is a sectional view of one cell of the sheet of FIG. 1, taken about line 2—2 thereof, and forming as first embodiment a packing peanut.

Referring to FIGS. 1 and 2, there is illustrated a first embodiment of the invention. FIG. 1 is a plan view of a molded packing sheet 10 of recycled newspaper molded by a vacuum molding process, has mold formed into the sheet, in regular columnar fashion, adjacent rows of offset dimples or surface projections 12 within sheet base 14 of a vacuum press molded packing member. The sheet 10 having a lateral width W, which in this case may be 12", is of uniform thickness and a length which is indeterminate since preferably the sheets 10 can be made on a continuous molding apparatus or molded as individual dimples. The thickness of the sheet base 14 may be 1/32". Such dimensions are exemplary, as are the dimensions of the diameter of the dimples or projections 12 and the lateral spacings between rows. As FIG. 1 shows, the rows are separated laterally about 1", specifically 0.95". The dimples or surface projections 12 in a given row have their centers spaced 1.1" and with the dimples of the second row offset from the first and third rows. The center of a dimple from one row is offset longitudinally in the direction of the length of the strip or sheet by 0.55".

In this embodiment, as seen preferably in FIG. 2, the dimples or projections are of a dome shape, including a cylindrical portion 16*a* of outer body 16 terminating at the end remote from base 14 in a spherical portion 16*b*. To provide rigidity to paired opposite cavities 18 and 20, FIG. 2, for a given cell or peanut 30, defined thereby, a divider wall in the embodiment of FIG. 2, indicated generally at 22, is integral therewith consisting of straight generally vertical walls 24, 26, extending from the base 14 side-by-side and separated by a minimal gap G, which may be on the order of 1/16 to ⅛", The divider walls 24, 26 of divider 22 are of the same thickness as base 14, as is the balance of each cell formed by the surface projection or dimple 12. Further, to facilitate separation from the mold, it is preferred that there be a slight diverging of opposite walls 24, 26 from base 14. Thus the gap G adjacent the base 14 is narrower than that at the opening 28 formed at the juncture between the flat near vertical walls 24, 26 and the spherical portion 16*b* of the outer wall 16. The depth of the dimple 12 may be 1" and the diameter of the projection may be of the same dimension from one exterior face of the spherical member to the opposite side face at cylindrical portion 16*a*.

It should be kept in mind that the wall thickness T, which may be 1/32" in the illustrated embodiment of FIGS. 1 and 2, should be the minimum possible that results in a stable shape, i.e., one that will not collapse as a result of compressive forces acting between the various packing peanuts 32 formed by a single cell 30 when employed in single element form or between the contacting projections 12 of packing sheet 10.

The base or sheet 14 is severed to cut out each of the projections or dimples 12 and thereby form a plurality of single, hollow, nonstable, packing peanuts 30 of recycled newspaper in elemental form approximating the portion of the assembly 10 as shown in FIG. 2. Such peanut 32 is characterized by flange 33 which may be rectangular, circular or the like in plan configuration depending upon the cut within sheet base 14, at some radial distance beyond the outer peripheral surface of cylindrical portion 16*a*, which joins directly to sheet 14. Further, the juncture between near-vertical walls 24 and 26 and sheet 14 forms hinges at 34, for each half of the peanut permitting the gap G to open under forces acting on the peanut 30 (or on each projection 12 when in the form shown in FIG. 1 after vacuum molding and employed as a wraparound packing sheet). In contrast, there is little or no flexing at the end of the peanut 30 where the spherical outer wall portion 16*a* merges or joins the outer ends of the near-vertical walls 24, 26 at gap G, remote from base 14.

While the peanuts 32 or the dimples 12, when uncut, are of dome shape, such elements may be formed as squares, hexagons, regular polygons trapezoidal trapezoids and with single flanges, double flanges, inside and outside flanged cylinders as representative of diverse forms for such recycled newspaper fill material components.

Such peanuts as shown at 32, FIG. 2, are in high contrast to the original peanuts made of recycled newspaper which were essentially irregular hollow bodies of elongated oval plan form, created by gluing cup halves together at the peripheries of two oppositely facing cup-like elements. While such elements had limited resilience, they had neither the flexibility nor resilience of peanut 32 under compressive stress. Peanut 32 has the halves thereof closing together, reducing the gap G when compressed or expanding the same when subjected to forces tending to open the cavity at hinges 34 of the near-vertical walls 24, 26, FIG. 2.

Further, where the cross section of such cells or single hollow element peanuts are trapezoidal or rectangular, by squeezing on the diagonal, one portion on the diagonal narrows while the opposite peanut portion expands, keeping a constant volume of packed material but permitting such peanuts to take up for shock and compression forces. Further, where the peanuts are formed as divided elongated cylinders, even where they terminate in spherical ends, as per FIG. 2 they tend to open at the gap end, much the same as a fish mouth does when compressed at flange 33.

In the manufacture of individual pellets or packing peanuts such as that shown at 30 in FIG. 2, chopped newspaper in the amount of 1 part newspaper by weight to 16 parts water, was blended in a kitchen blender for approximately five minutes. The resulting slurry, which is highly stable, was applied to dome shaped surfaces of a mold screen by means of a vacuum drawn behind the screen. With such screen in place in a female mold, a male mirror image counterpart projection is insertable within the female mold recess permitting the creation of elemental peanuts as at 30, by capture of the water and newspaper slurry between the mold parts. Preferably, the shredded newspaper and water slurry in the screen is vacuum and mechanically pressed within the mold. The male mold is then backed out of the screened female mold, while a slight positive pressure is applied behind the screen. This allows the pellet to be separated from the screen surface after which it is put into the toaster oven for drying out any water remaining within the vacuum formed peanut bearing base. Draft angles are required and the screen is an important element in the molding apparatus. The draft angles are effected by flaring the near-vertical walls 24, 26 of the female mold outwardly. This permits the separation of the mold on the lower side, FIG. 2, from the press molded outer peripheral surface of the projections 12, FIG. 1.

Preferably, one of the male and female mold halves is completely lined with a screen. Further, the mating face of the screen is immersed partly into a slurry mixture and a vacuum drawn on the back side of the screen to ensure an even deposition of the cellulose on the front side of the screen. Assuming that the screen is on the female mold half, the male or opposite half is moved downwardly to press the slurry film against the screen. Afterwards, the upper half mold is withdrawn and air pressure is applied to the back side of the screen to blow the molded and dried piece out of the screen recess, with the molded sheet product taking the form shown in FIG. 1.

As may be appreciated, the cellulose material when it is formed, whether as an egg carton or a hollow, nonnestable packing peanut of recycled newspaper is of relatively fixed density (since all of the water is removed from the cellulose fiber). Thus, it is the shaping of the peanut which provides the weight saving features, not the change in the mold material. In making of the initial samples to the forming of the peanuts in various embodiments described herein and as shown in the drawings, a weight which was as much as ten times over that of the styrofoam peanuts of equivalent size was reduced to perhaps four times the weight of such styrofoam elements.

By making the divider cavity as small as possible, weight is reduced. For instance, the divider may be limited to ½ the distance from the base to the tip of the spherical section **16*b*, i.e., the internal divider walls then rise from the spherical portion to a plane at the juncture between the cylindrical portion 16*a* and the spherical end 16*b* remote from the base 14**. The performance standard determines the necessary resilience and shock absorbing qualities of the peanut. Where the packed item is not fragile, and the packing is primarily a fill rather than for high energy absorbing capability, the peanuts may be of simpler design and without consideration to flexing point presence or absence of flanges and limitations on the height of a divider for open sections.

As may be appreciated, where the hollow peanuts are of open section form, such as dome shape, flanges are required about the periphery of the open end of that dome to give sufficient rigidity. Additionally, they frustrate the tendency for the peanuts to nest partially or wholly within a like configured hollow peanut. In contrast, where the molded peanuts are of closed section, such as hollow, square cross section; hollow, rectangular cross section; hollow, hexagonal or octagonal cross section, etc., the walls defining a closed cavity are sufficient in and of themselves to maintain structural rigidity while flexing somewhat at the junction between walls as for instance at opposite diagonals with one diagonal expanding while the other contracts under force application (shock load or otherwise). It is preferred that the peanut has the ability to rebound to original shape after the load is removed. That resiliency is enhanced by the flexing or pivoting of a planar wall such as divider walls at the junction of the divider and the base from which the divider emanates or, alternatively, at some point intermediate the spherical end and the base in the example of FIGS. 1 and 2. By taking a given dimension rectangular box or carton, depending upon the packing peanut shape, packing efficiency may be determined by the formula $Pe = NxV_p$ over $V_c$. Where the packing peanut volume equals $V_p$, the total number of pieces equals n and the container volume equals Vc with the void volume $V_v$ and wherein $V_c + V_v + NxV_p$.

Under these conditions, low efficiency is desirable since $NV_p$ is proportional to weight. Further, this variable can only be determined empirically. It should also be noted that since cost of production is nearly directly proportional to the number of pieces, minimizing the number of pieces per cubic foot is desireable.

Referring to FIG. 13, calculations were made for a packing peanut of the type shown at 32. FIG. 2 with a base including a flange 0.93"×1.09" (rectangle). Such peanut is arbitrarily identified by shape no. 2, while shape no. 1 is identical thereto, absent the base i.e. no external flange for the dome-shaped body with a central divider running the complete vertical height of the dome-shaped member.

A determination of low packing efficiency favorable to reduced weight for the packing pieces involved was undertaken as follows. A clear plastic box of inside dimensions 4.62"×2" was employed in the test. The number of peanuts required to fill the box to an observable density was initiated. The inside volume of the box was equal to 42.7 cubic inches, and the weight of the box 95.8 grams.

Trial 1. Shape 2:

number of pieces 48;
gross box weight 120.6 gr;
net weight 24.8 gr.

$$\frac{\text{Weight}}{\text{Volume}} = \frac{24.8\text{ gr}}{42.7\text{ in}^3} \times \frac{1\text{ lb}}{454\text{ gr.}} \quad \frac{1728\text{ in}^3}{\text{ft}3} = \frac{2.21\text{ lb}}{\text{ft}^3}$$

1942 pieces/ft$^3$

Trial 2. Shape 1:

number of pieces 62;
gross weight 124.4 gr;
net weight 28.6 gr.

$$\frac{\text{Weight}}{\text{Volume}} = 2.55\text{ lb/ft}^3$$

2509 pieces/ft$^3$

CONCLUSION

Shape 2 is 14% less in weight than shape 1.

Shape 2 is 23% less pieces to fill the box than shape 1.

By experimentation, it was determined that an increase in strength of a packing peanut in accordance with FIG. 2 of the drawing and stiffening of the section generally could be achieved by raising the channel hinge point in the direction of the spherical top of the dome and the adding of material to the minimum cross section location the rigidity of the structure was considerably improved. In such case, the hinge points of walls 24. 26 were moved to approximately ¼ the distance from the base to the top of the dome.

FIG. 13 is a plot with variation in base diameter in inches against bulk weight in pounds per cubic foot to show the change in bulk density versus shape as the size of the peanut varies. Plot line A represents the greatest packing efficiency for peanuts whose configuration is generally that shown in the upper left hand corner of the graph, with D=H for all three forms of the peanuts.

By using a partial divider wall, where the divider walls emanate from the apex of the spherical portion but do not reach the base of the dome-shaped hollow peanut the bulk weights in pounds per cubic foot average about 0.9.

In contrast, for the same wall thickness of 0.020" for a full divider from the apex of the spherical portion of the peanut to the base, the bulk density increases with the curvature approximating that of the curve A.

The bulk weight increases significantly from the partial divider to the full divider configuration peanut, in this case averaging 1.25 bulk weight pounds per cubic foot. By increasing the wall thickness by another 0.005", to point 0.025" and with the peanut being of dome shape with a full height divider, the average bulk weight in pounds per cubic foot rose to 1.6. As the base diameter increases, the bulk weight in pounds per cubic foot drops proportionally for all three variations of the same basic hollow, non-nestable packing peanuts of recycled newspaper.

Figure 3:
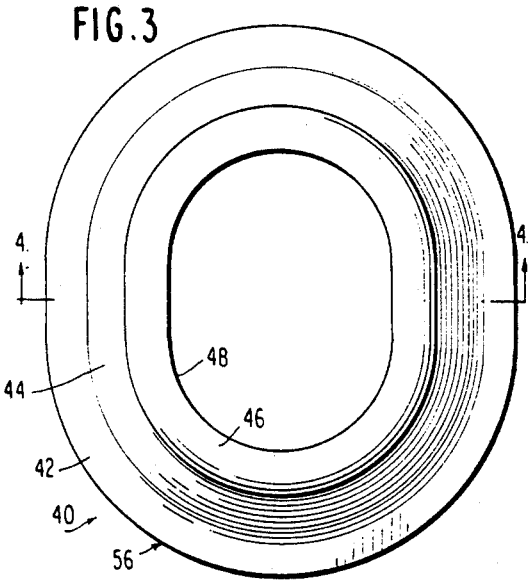
FIG. 3 is a top plan view of a vacuum molded, thin walled packaging peanut of recycled newspaper forming a second embodiment of the invention.
Figure 4:
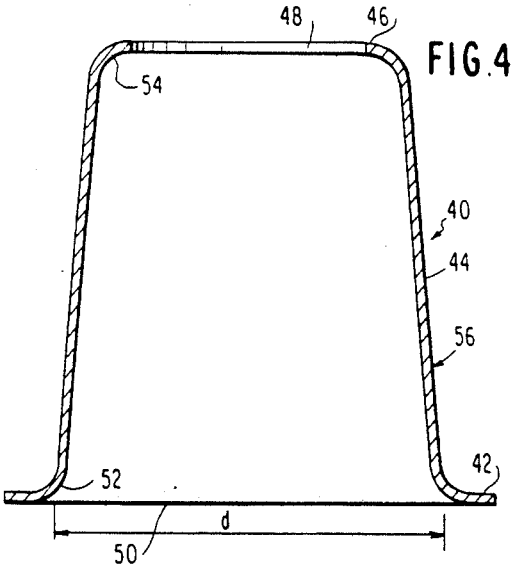
FIG. 4 is a vertical sectional view of the peanut of FIG. 3 taken about line 4—4.
Figure 5:
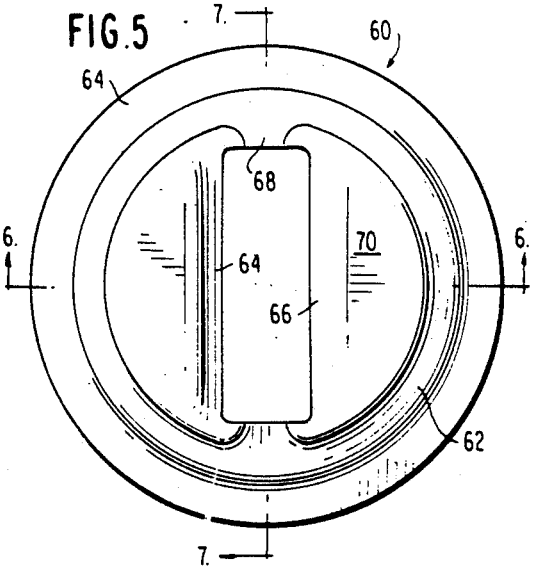
FIG. 5 is a top plan view of a packing peanut of vacuum molded, recycled newspaper forming a third embodiment of the present invention.
Figure 6:
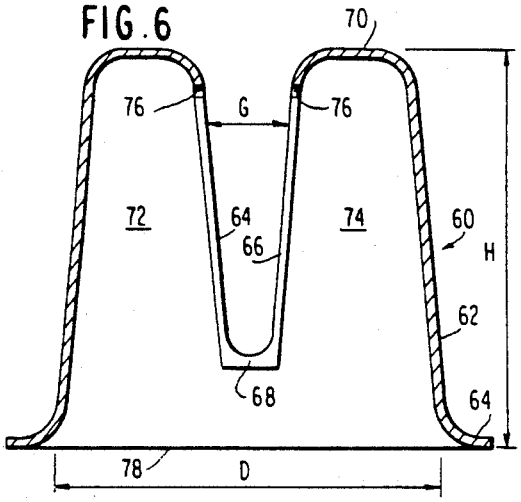
FIG. 6 is a vertical sectional view taken about line 6—6 of FIG. 5.

FIGS. 3 and 4 show a further embodiment of the invention in which, in vertical section, the hollow, non-nestable packing peanut of recycled newspaper, indicated generally at 40, is of frustro-conical form, including a base 42, a conical wall 44 of generally oval plan configuration, FIG. 3, rising from the base to a flat upper or top wall 46. An oval opening or hole 48 is formed within the top wall at 48. The base reference is dimension d which is essentially the lateral width of the conical wall 44 at the bottom opening 50 within that peanut. The base formed flange 42 gives stability about the outer periphery of the hollow, frustro-conical form peanut 40, influenced by the rounded edge 52 at the corner between the flange defined by base 42 and the conical wall 44 leading to the top wall 46 of the peanut. Rigidity is also effected by the transition from the conical wall 44 to top wall 46 at 54. The thickness of the body 56 is uniform throughout that body from flange 42 to the top wall 46 bearing the hole or opening 48. The peanut 40 is relatively simple in form, and may satisfy most fill material requirements. Turning to drawing FIGS. 5, 6 and 7, there is shown a further embodiment of the invention in which a packing peanut, indicated generally at 60, in this case is of pure conical form with a conical outer wall 62, emanating from base 64 which forms an annular flange upwardly and outwardly oblique divider walls 64, 66, which form a gap G therebetween and rise vertically upward from a horizontal short width junction wall 68 which is at some vertical height 0.2 times the inside diameter of the frustro-conical, hollow peanut 60. The upwardly and outwardly flaring divider walls 64, 66 for divider, indicated generally at 69, connect to top wall 70 which, in turn, joins the outer conical wall 62. The net effect is to form two cavities 72 and 74 separated by divider 69.

Figure 7:
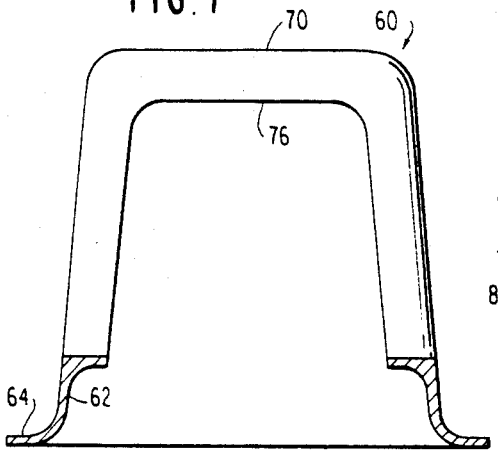
FIG. 7 is a vertical sectional view of the peanut of FIG. 5 taken about line 7—7.

As seen in the sectional view of FIG. 7, the packing peanut 60 has good resiliency and tends to retain its shape even if the divider walls 64, 66 are flexed towards each other under impact force or sustained compressive force acting on the peanut 60. The presence of the annular flange 64 provides rigidity to the open end 78 of the hollow body. The peanut wall thickness is uniform with the exception of the corners of a flat, horizontal bottom wall 68 of divider 69. Wall thickness is preferably 0.03" in the illustrated embodiment. The overall height H is in excess of the nominal base diameter D and the horizontal wall 68 of the divider is 0.2 times the nominal diameter of the base portion at opening 78 of the resilient hollow non-nestable packing element 60.

Figure 8:
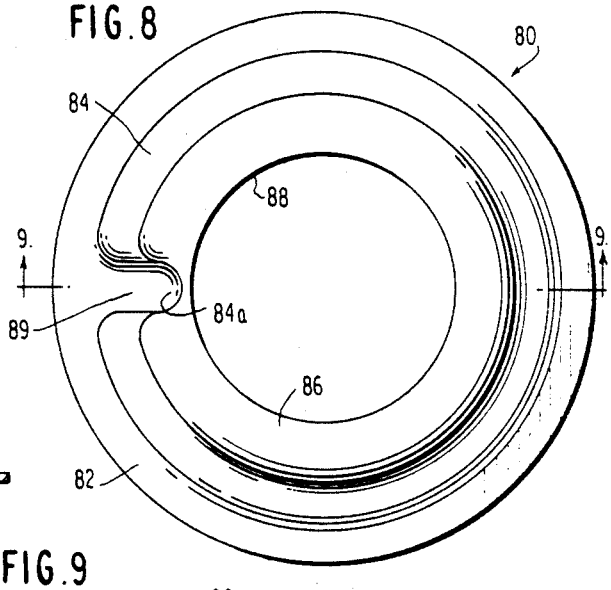
FIG. 8 is a top plan view of a packing peanut of recycled newspaper forming yet a further embodiment of the invention.
Figure 9:
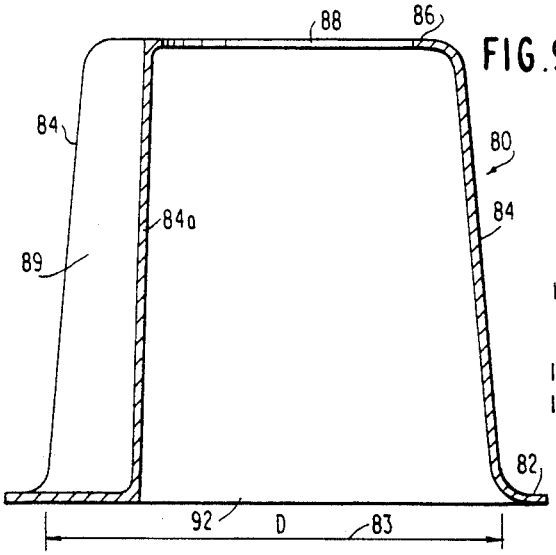
FIG. 9 is a vertical sectional view of the peanut of FIG. 8 taken about line 9—9 thereof.

Referring next to FIGS. 8 and 9, a hollow, axially open non-nestable packing peanut 80 of recycled newspaper takes the form of a fluted cone with flanges, including a flanged, horizontal, flat base 82, whose base reference diameter D is indicated by arrow 83. The conical outer wall 84 rises from flange 82 and decreases in diameter from the bottom opening 92 to top opening 88 within a top wall 86 integral with the upper end of the conical outer wall 84. In contrast to the prior conical embodiments, this peanut is provided with a flute, indicated generally at 89; that is, a radial groove which extends from the flat bottom wall or flange 82 to top wall 86, inwardly from conical wall 84 to conical wall portion **84*a*. Conical wall portion 84*a* has a 2° draft which is less than the draft provided to the main conical wall 84 about the majority of the periphery of this fluted conical packing peanut 80. As a result, there is a significantly increased rigidity at flute 89 resisting flexing and reducing the resilience of the peanut to absorb shock and to flex as a result force imposed the body 94 of this peanut 80**. After fabricating peanuts of this configuration by methods previously described, and then calculating packing effectivenss by methods previously described, it was determined that 809 pieces weight 0.98 pounds and provide for 1.0 cubic feet of fill.

Figure 10:
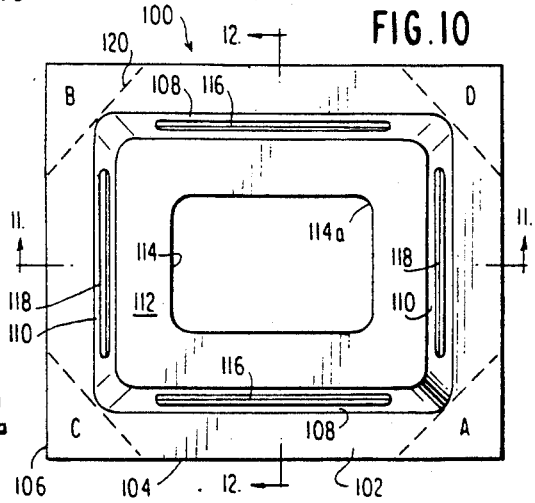
FIG. 10 is a top plan view of a packing peanut of recycled newspaper forming yet a further embodiment of the present invention.
Figure 11:
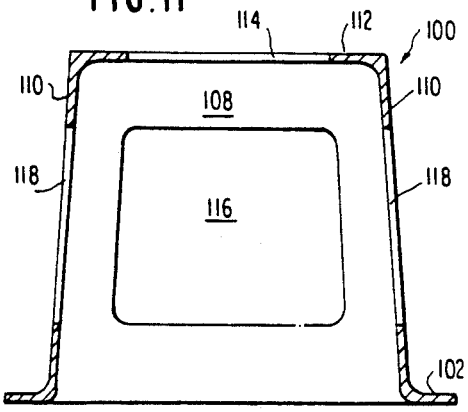
FIG. 11 is a vertical sectional view of the packing peanut of FIG. 10 taken about line 11—11.
Figure 12:
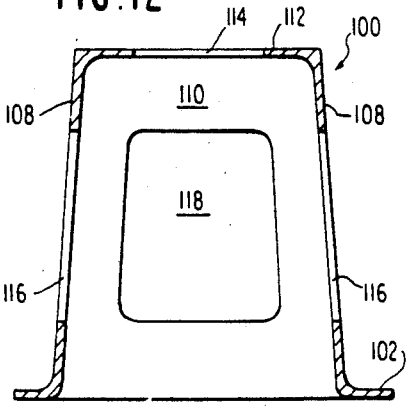
FIG. 12 is a vertical sectional view of the packing peanut of FIG. 10 taken about line 12—12.

With reference to FIGS. 10, 11 and 12, a frustro-pyramidal, hollow, non-nestable packing peanut 10 of recycled newspaper forms yet a further embodiment of the invention, which significantly improves the cushioning at the expense of structural integrity. Base 102 is initially formed as a rectangle having long sides 104 and short sides 106. Opposed frustro-pyramidal long walls 108 rise from the base 102, and are integrated with rounded corners to short length opposite side walls 110. A unitary top wall 112 is provided with a rectangular cut out or hole 114 with rounded corners 114*a*. Additionally, trapezoidal windows or holes 116 are formed within the long side walls 108 of the frustro-pyramidal, unitary peanut 100, while like trapezoidal windows or holes are formed at 110 within opposed short side walls 110 of peanut 100.

Preferably, the corners of the base 102 are cut off at diagonal lines 120. As may be appreciated, the packing peanut may be fabricated without cut outs or holes 116 and 118, although preferably the top opening or hole 114 is employed to give some cushioning capability to the packing peanut. By cutting off of flange parts at diametrically opposed corners A, B and C, D, the rigidity of the stiff shell is materially enhanced.

While the invention has been described in terms of several embodiments, the invention is not so limited in its scope and covers the equivalents thereof as defined broadly by the claims appended thereto.

What is claimed is,

1. A lightweight non-nestable packing peanut for use as a loose fill material in packing objects within sealed cartons, with the fill material under compression said packing peanut comprising:

a cellulose fiber, biodegradable molded hollow, thin walled shell of recycled newspaper, said shell including means within a portion of said shell for providing shape stability thereto for resisting physical crushing of said shell thereby structurally cushioning said packed objects, and means for rendering said shell resilient over a portion thereof for absorbing the energy resulting from impact forces transmitted through said fill material towards said packaged objects.

2. A packing peanut as claimed in claim 1, wherein said shell is of dome shape, having an open end and said flanged base extends radially from said open end of said hollow thin wall shell.

3. A packing peanut as claimed in claim 2, wherein said dome shaped shell comprises a cylindrical portion integral with said flanged base and said cylindrical portion terminates in a spherical portion remote from said base.

4. A packing peanut as claimed in claim 2, wherein said shell includes an integral divider extending longitudinally generally from said open end to the end of said dome shaped shell remote from said base.

5. A packing peanut as claimed in claim 3, wherein said shell includes an integral divider extending longitudinally generally from said open end to the end of said dome shaped shell remote from said base.

6. A packing peanut as claimed in claim 4, wherein said divider comprises spaced parallel walls extending from the end of said shell remote from said base towards said base integral with said shell and including an integral transverse wall joining the same and forming hinges therewith, whereby said shell is separated into two halves which may flex towards and away from each other at the gap between said divider walls.

7. A packing peanut as claimed in claim 6, wherein said divider transverse wall is flush with said shell flanged base.

8. A packing peanut as claimed in claim 6, wherein said divider transverse wall is offset axially from said flanged base.

9. A packing peanut as claimed in claim 8, wherein said divider transverse wall is axially offset from said flanged base approximately one fourth the axial height of said shell.

10. A packing peanut as claimed in claim 1, wherein said shell is of frustro-conical shape having an open end, wherein said integral radial flanged base is at said open end and having a conical side wall integral with said flanged base, tapering inwardly and terminating in an integral transverse top wall at an end remote from said base, closing off said hollow shell at that end.

11. A packing peanut as claimed in claim 10, wherein said shell side wall is of oval transverse cross section.

12. A packing peanut as claimed in claim 10, wherein said side wall includes a flute therein over the axial height of the shell and comprising said shape stability means.

13. A packing peanut as claimed in claim 10, wherein said conical shell side wall has a draft angle of from 5° to 15° and said flute has a draft angle of approximately 2°.

14. A packing peanut as claimed in claim 10, wherein said shell includes an internal divider extending from said open end of said shell generally to the end of said shell remote from said base.

15. A packing peanut as claimed in claim 14, wherein said divider extends axially over approximately three fourth of said shell.

16. A packing peanut as claimed in claim 14, wherein said divider includes a pair of generally parallel laterally spaced walls forming a narrow gap therebetween and wherein said divider walls are joined by a transverse wall at ends remote from said shell top wall forming hinge connections therewith.

17. A packing peanut as claimed in claim 16, wherein said pair of divider walls include openings therein facing each other to reduce the weight of the peanut shell.

18. A packing peanut as claimed in claim 1, wherein said shell is of frustro-pyramidal shape having an integral, radially flanged axially open base and two pairs of opposite side walls integrally joined together along opposite edges and at said base and a top wall remote from said base and integral with said side walls and closing off the shell.

19. A packing peanut as claimed in claim 18, wherein at least one pair of said side walls have openings therein to reduce the weight of said shell and to partially form said resilient means.

20. A packing peanut as claimed in claim 19, wherein said top wall includes an axial opening therein.

21. A packing peanut as claimed in claim 19, wherein said frustro-pyramidal shell includes diametrically opposed long side walls and diametrically opposed short side walls.

* * * * *

Adverse Decisions In Interference

Patent No. 5,151,312, John L. Boeri, HOLLOW, NON-NESTABLE PACKING PEANUTS OF RECYCLED NEWSPAPER, Interference No. 103,517, final judgment adverse to the patentee rendered October 30, 1997, as to claims 1 to 21.

*(Official Gazette June 2, 1998)*